United States Patent [19]

Bücker et al.

[11] 4,282,273

[45] Aug. 4, 1981

[54] PROCESS AND APPARATUS FOR GALVANIZING A WIRE

[75] Inventors: Werner Bücker, Düsseldorf; Christian Rademacher, Neuss, both of Fed. Rep. of Germany

[73] Assignee: Messer Griesheim GmbH, Frankfurt am Main, Fed. Rep. of Germany

[21] Appl. No.: 28,194

[22] Filed: Apr. 9, 1979

[30] Foreign Application Priority Data

Apr. 10, 1978 [DE] Fed. Rep. of Germany ..... 2815485

[51] Int. Cl.[3] ..... B05D 3/00

[52] U.S. Cl. ..... 427/398.3; 427/398.4; 427/398.5; 427/433; 427/434.2; 427/434.6; 427/436

[58] Field of Search ..... 427/433, 434.2, 434.6, 427/398 B, 398 C, 398 D, 436, 398.3, 398.4, 398.5

[56] References Cited

U.S. PATENT DOCUMENTS

| | | | |
|---|---|---|---|
| 3,060,056 | 10/1962 | Scott | 427/398 B |
| 3,369,923 | 2/1968 | Laidman | 427/398 C |
| 3,632,411 | 1/1972 | Stark | 427/433 |
| 3,698,938 | 10/1972 | Mayhew | 427/398.4 |
| 3,738,861 | 6/1973 | Schiffer et al. | 427/433 |
| 3,932,683 | 1/1976 | Robins | 427/433 |
| 3,941,906 | 3/1976 | Bostroem | 427/433 |

OTHER PUBLICATIONS

Sittig, M., *Nitrogen In Industry*, Van Nostrand Co., Princeton, N.J.

*Primary Examiner*—Ronald H. Smith
*Assistant Examiner*—Janyce A. Bell
*Attorney, Agent, or Firm*—Connolly and Hutz

[57] ABSTRACT

A wire being galvanized leaves a zinc bath with the adhering liquid zinc forming after solidification of the zinc layer and with the surface of the wire being rapidly cooled by a cooling agent such as liquid nitrogen immediately after leaving the zinc bath to increase the thickness of the adhering zinc.

9 Claims, 2 Drawing Figures

PROCESS AND APPARATUS FOR GALVANIZING A WIRE

BACKGROUND OF INVENTION

The invention relates to a process and an apparatus for galvanizing a wire whereby the wire vertically leaves a zinc bath and the adhering liquid zinc forms the zinc layer after its solidification. Depending on the wire speed, bath temperature, wire dimension and similar influences, a certain portion of the liquid zinc adhering to the wire flows back into the bath. As a result, a certain thickness of the zinc layer remains on the wire. The zinc layer which can be attained in this way is too thin for many types of application.

An attempt was made to attain a thicker zinc layer by a method in which the wire was exposed immediately after leaving the zinc bath to a gas atmosphere which contained hydrogen sulfide as the active component. Hydrogen sulfide is, however, a very toxic and chemically very aggressive gas so that the implementation of such a process presents problems in practice.

SUMMARY OF INVENTION

The invention is based, therefore, on the objective of providing a process and an apparatus for galvanizing a wire whereby the wire vertically leaves the zinc bath and the adhering liquid zinc forms after its solidification the zinc layer, which permits an increase in the layer thickness of the adhering zinc without the assistance of toxic and aggressive agents.

This is attained according to the invention by rapidly cooling the surface of the wire immediately after it leaves the zinc bath by means of a cooling agent.

As a result, a rapid solidification of the liquid zinc present on the wire is effected, the amount of zinc which flows down from the wire is, therefore, reduced. As a result, the layer thickness is increased.

Cooling can take place by means of direct contact of the surface of the wire with the cooling agent, for example, by spraying. Optionally, the evaporated cooling agent can in this case also be used in addition as protective gas for the still sensitive surface of the galvanized wire. The surface of the wire can, however, also be cooled indirectly by leading it, after it leaves the zinc bath, through a wire-surrounding chamber, the inside wall of which is cooled by the cooling agent.

A low boiling liquified gas, for example, nitrogen is preferably used as a cooling agent. The evaporated nitrogen can be used as a protective gas for the still sensitive galvanized wire. It can also be used as a carrier gas for a reaction gas such as ammonia or hydrogen sulfide.

An apparatus to implement the process according to the invention with a direct contact between galvanized wire and cooling agent consists of a tube which surrounds the wire leaving the zinc bath, is partially submerged in the zinc bath and is surrounded by an annular chamber just above the zinc bath surface, which has a supply line for liquid nitrogen and spray orifices for liquid nitrogen directed on the wire. In the area of the dipping location into the zinc bath, the tube preferably consists of an insulating material, for example, an oxide ceramic which restrains the heat flow into the annular chamber.

THE DRAWINGS

FIG. 1 shows an apparatus in accordance with this invention for direct contact between wire surface and cooling agent; and FIG. 2 shows an apparatus for indirect contact between wire surface and cooling agent.

DETAILED DESCRIPTION

Figure 1:
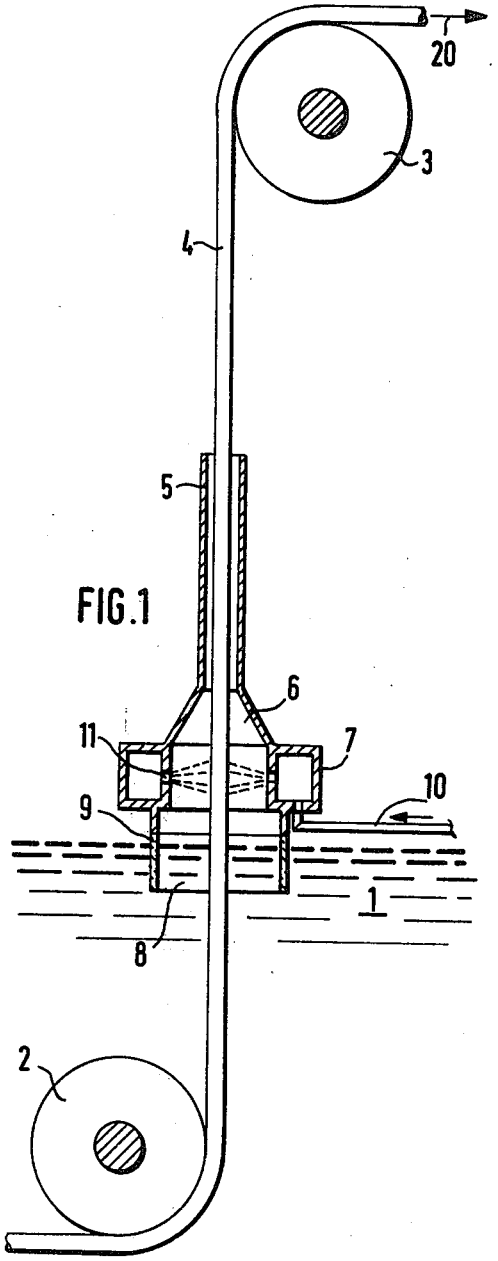

FIG. 1 represents a zinc bath from which the wire workpiece to be galvanized leaves vertically upwards by means of deflection rolls 2,3. According to the invention, the wire 4 is surrounded by a tube 5 which changes into an annular chamber 7 by means of a conical transition piece 6. The annular chamber 7 is arranged immediately above the exit location of wire 4 from the zinc bath 1. In extension to the tube 5, an additional tube 8 is connected below the annular chamber 7, which is submerged into the zinc bath 1. This tube 8 consists at least in the area of the dipping location of an insulating material 9 which restrains the heat flow from the zinc bath 1 into the annular chamber 7.

A supply line 10 for liquid nitrogen is connected to the annular chamber 7. The liquid nitrogen exits through spray nozzles 11 which are directed on the wire 4. Because of the low temperature of the liquid nitrogen, the liquid zinc present on the wire immediately solidifies in the area of the spraying location. It does not have the opportunity to flow back along the wire 4 into zinc bath 1. As a result a substantially thicker zinc layer is obtained than would be possible without the measure according to the invention.

The evaporated nitrogen flows upwards through the tube 5 and leaves the installation. It functions here as a protective gas for the zinc layer which is still sensitive. If desired, reaction gases such as ammonia, hydrogen sulfide or gaseous liquid hydrocarbons can still be introduced in the tube 5.

Figure 2:
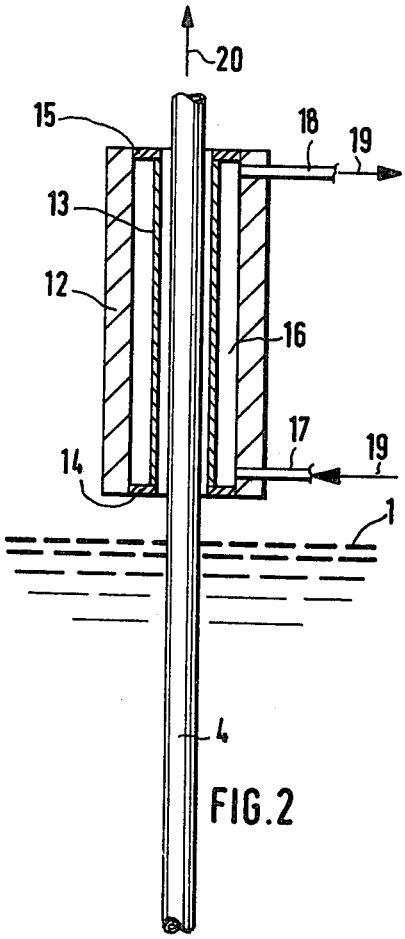

FIG. 2 shows an apparatus for indirect cooling of wire 4 leaving the zinc bath 1. This apparatus consists essentially of a double-walled tube, both tubes 12,13 of which are connected with each other at the top and bottom by annular flanges 14,15. In this way, an annular chamber 16 is formed through which the cooling agent flows. The annular chamber 16 has a supply line 17 and a drain 18 for the cooling agent. The flow direction is indicated by arrows 19 as well as the direction motion of the wire 4 by an arrow 20. This apparatus is especially suitable for those cooling agents which do not evaporate during the cooling procedure, but remain liquid, in other words, cooling agents which are introduced in undercooled state into the apparatus.

What is claimed is:

1. In a process for galvanizing a workpiece wherein the workpiece vertically leaves a zinc bath and the adhering liquid zinc forms the zinc layer after its solidification, the improvement being rapidly cooling the surface of the workpiece in a shock-type manner immediately after it leaves the zinc bath by means of a low boiling liquified gas cooling agent without any high temperature gas being applied to the workpiece in the time period between the workpiece leaving the zinc bath and the low boiling liquified gas being applied to the workpiece.

2. Process according to claim 1, characterized in that the surface of the workpiece is cooled by the cooling agent as a result of direct contact.

3. Process according to claim 2, characterized in that the surface of the workpiece is cooled by the cooling agent by means of spraying.

4. Process according to claim 1, characterized in that the surface of the workpiece is cooled indirectly.

5. Process according to claim 1, characterized in that cooling the surface of the workpiece is effected by liquid nitrogen.

6. Process according to claim 5, characterized in that the evaporated nitrogen functions as protective gas for the galvanized workpiece.

7. Process according to claim 5, characterized in that the evaporated nitrogen functions as carrier gas for a gas which actively affects the surface of the galvanized workpiece.

8. Process according to claim 5, characterized in that the surface of the workpiece is cooled as a result of direct contact by spraying.

9. Process according to claim 5, characterized in that the surface of the workpiece is cooled indirectly.

* * * * *